US005664394A

United States Patent [19]

Sweeney

[11] Patent Number: 5,664,394

[45] Date of Patent: Sep. 9, 1997

[54] BASE FOR EQUIPMENT

[75] Inventor: Jeff S. Sweeney, Atlanta, Ga.

[73] Assignee: DiversiTech Corporation, Conyers, Ga.

[21] Appl. No.: 509,769

[22] Filed: Aug. 1, 1995

[51] Int. Cl.[6] ..... B65D 19/18

[52] U.S. Cl. ..... 52/782.1; 52/309.8; 52/745.2; 108/56.3; 108/901; 248/346.02; 248/346.3; 248/678

[58] Field of Search ..... 52/782.1, 309.8, 52/309.7, 309.4, 745.2; 108/51.1, 56.1, 56.3, 901, 902; 248/664, 678, 346.02, 346.3

[56] References Cited

U.S. PATENT DOCUMENTS

| | | | |
|---|---|---|---|
| 2,925,978 | 2/1960 | Marson . | |
| 3,598,065 | 8/1971 | Young | 108/56.3 X |
| 3,605,651 | 9/1971 | Stewart . | |
| 3,610,173 | 10/1971 | McIlwraith . | |
| 3,685,463 | 8/1972 | Francis | 108/56.3 |
| 3,835,792 | 9/1974 | Wharton . | |
| 3,902,692 | 9/1975 | Skinner | 248/346.02 |
| 4,056,251 | 11/1977 | Dixon et al. | 248/678 |
| 4,103,857 | 8/1978 | Levenhagen | 248/346.02 X |
| 4,185,565 | 1/1980 | Nymoen . | |
| 4,212,446 | 7/1980 | Domanick et al. | 248/678 |
| 4,290,369 | 9/1981 | Propst et al. . | |
| 4,319,370 | 3/1982 | Robinson . | |
| 4,597,338 | 7/1986 | Kreeger . | |
| 4,843,976 | 7/1989 | Pigott et al. . | |
| 4,869,456 | 9/1989 | Jacobs | 248/678 |
| 5,088,418 | 2/1992 | Reckermann et al. | 108/56.1 X |
| 5,195,439 | 3/1993 | Harder | 108/901 X |
| 5,197,396 | 3/1993 | Breezer et al. | 108/56.3 |
| 5,205,221 | 4/1993 | Melin et al. | 108/901 X |

FOREIGN PATENT DOCUMENTS

| | | | |
|---|---|---|---|
| 997689 | 9/1976 | Canada . | |
| 4-267736 | 9/1992 | Japan . | |
| 1330180 | 9/1973 | United Kingdom | 108/56.3 |

*Primary Examiner*—Christopher T. Kent
*Attorney, Agent, or Firm*—Jones & Askew

[57] ABSTRACT

A base for equipment, including a pad having a top surface, a plurality of side surfaces, and a core with a bottom side. The core has at least one recess in its bottom side. At least one removable insert foot mates with the at least one core recess such that the insert foot extends beyond the bottom side of the core. Similarly, rather than using a pad with a core, the pad is hollow with a top surface, a bottom surface, and a plurality of side surfaces. The bottom surface has at least one recess therein for mating with at least one removable insert foot. Likewise, the pad can have a top, a bottom, and a plurality of side surfaces with the bottom surface having a plurality of supports ribs extending therefrom. A removable pallet insert or a plurality of removable pallet sleds with a plurality of feet mate with the ribs on the bottom surface such that the feet extend beyond the bottom surface of said pad.

35 Claims, 3 Drawing Sheets

BASE FOR EQUIPMENT

RELATED APPLICATIONS

Application Ser. No. 08/416,198, filed Apr. 4, 1995, entitled "Light-Weight High-Strength Composite Pad and Method of Making Same," assigned to DiversiTech Corporation, the assignee of the present application, is attached hereto as Appendix A. application Ser. No. 08/416, 198 discloses a preferred embodiment of a composite material equipment base of the present invention and is incorporated herein by reference. If application Ser. No. 08/416, 198 is allowed, then Appendix A will be canceled and reference to the allowed application will substituted as provided by MPEP § 608.01(p)B. If application Ser. No. 08/416,198 is not allowed or is abandoned, then Appendix A will be incorporated into the specification of this application by amendment to satisfy the best mode disclosure requirements.

TECHNICAL FIELD

This invention relates generally to a base for equipment, and more particularly, to a pad for the mounting of equipment that can also function as a transport pallet.

BACKGROUND OF THE INVENTION

Pad Art

The use of a base or a pad for mounting various types of equipment is well known in the art. For example, air conditioning condensers, heating units, and electrical transformers are often mounted on a pad to insure that the unit remains stable, level, and off of the ground during operation. The use of an equipment pad is generally required under local and model building codes.

Equipment pads are often constructed from concrete. Because of the weight involved, these concrete pads are generally poured and smoothed at the construction site. Building concrete pads, however, can be a time consuming process and often requires heavy equipment and several laborers. Further, because the pads can only be poured when the weather permits, pad construction may delay an entire project.

Recent improvements in the art have focused on precast equipment pads and pads made from composite materials. Composite materials are perceived as concrete but are often preferred because the composite material is light-weight and can support the same or even greater loads than concrete. Further, while concrete equipment pads must be poured at the construction site, pads made from composite materials can be manufactured off-site, stored and stacked until needed, and then easily transported to the construction site. A composite material equipment pad can then be installed without heavy equipment and with little site preparation. As discussed below, a number of composite materials pads can be stacked and secured on to a transport pallet for transport to a warehouse or construction site.

An example of an equipment pad made from a composite material is found in commonly owned U.S. Pat. No. 4,505, 449, entitled "Lightweight Concrete Cladded Heavy Equipment Base." One of the preferred embodiments of this invention comprises a polystyrene foam core covered on five sides with a fiberglass and cement composition. The resultant pad is only ⅛th to 1/16th the weight of an ordinary concrete pad, but has sufficient load strength to function as a heavy equipment pad. The disclosure of U.S. Pat. No. 4,505,449 is incorporated hereto by reference.

Similarly, commonly owned application Ser. No. 08/416, 198, entitled "Light-Weight High-Strength Composite Pad and Method of Making Same" (attached hereto as Appendix A), discloses a composite pad having a reinforced core comprising a rigid board and at least one reinforcing coating on one or more sides of the board. The reinforcing coating comprises a foamable material with a fibrous fabric bonded thereto. At least one layer of a slurry mixture then covers the reinforcing coating. A pad made according to this invention pad can support over 325 pounds per square inch of concentrated load and has over 400 pounds in flexural strength. The composite pad, however, weighs only 1/12th of its solid concrete counterpart.

Pallet Art

Also well known in the art is the use of pallets and other types of platforms to transport equipment and other heavy objects. The pallets are used to secure and protect the equipment or other object during transport. A pallet is generally designed so as to provide room for the tines of a forklift or other device to lift and maneuver the pallet and the equipment to the appropriate location. After the equipment is maneuvered into place, the pallet is often discarded.

For example, wooden pallets have long been used to transport air conditioning condensers and other types of equipment to a construction site. Wooden pallets, however, are relatively expensive to manufacture and have a limited useful lifetime.

Recent improvements in the art have included plastic pallets and the use of other types of synthetic materials. For example, U.S. Pat. No. 3,835,792, entitled "Pallet Construction" discloses a two piece pallet made from molded plastic. The top piece is a corrugated deck with several downwardly descending support pads. The second piece is a base with several upwardly extending pads. Each set of pads has a locking mechanism. The space between the pads provides clearance space for the tines of a forklift. Similarly, U.S. Pat. No. 4,843,976, entitled "Plastic Pallet;" U.S. Pat. No. 4,597, 338, entitled "Pallet;" and U.S. Pat. No. 3,610,173, entitled "Plastic Pallet" all disclose two piece thermoformed plastic pallets. Both upper and lower pieces are identical with support columns holding the two pieces together.

Although the use of both pads and pallets is well known in the art, there is a need for an improved equipment base that can carry out the functions of both a pallet and a pad. Such an equipment base would first and foremost serve as an adequate pad for the installation of equipment and comply with all applicable building codes. Such an equipment base also could function as a pallet to secure equipment during transport and provide room for the insertion of forklift tines. Such a combination would eliminate the need for a separate transport pallet and speed the installation time of the equipment at the construction site.

SUMMARY OF THE INVENTION

Generally described, the present invention relates to a base for equipment, including a pad having a top surface, a plurality of side surfaces, and a core with a bottom side. The core has at least one recess in its bottom side. At least one removable insert foot mates with the at least one core recess such that the insert foot extends beyond the bottom side of the core. Similarly, rather than using a pad with a core, the pad is hollow with a top surface, a bottom surface, and a plurality of side surfaces. The bottom surface has at least one recess therein for mating with at least one removable insert foot. Likewise, the pad can have a top, a bottom, and a plurality of side surfaces with the bottom surface having a plurality of supports ribs extending therefrom. A removable pallet insert or a plurality of removable pallet sleds with a plurality of feet mate with the ribs on the bottom surface such that the feet extend beyond the bottom surface of said pad.

The pad is constructed from a plastic or a composite material. Likewise, the pallet feet or insert feet are constructed from a plastic material or other conventional materials, including expanded polystyrene. The pallet feet mate with the pad recesses or ribs via a snap fit, adhesives, or other conventional means.

In a preferred embodiment, the pad mates with six pallet feet or a pallet insert with six feet. The pallet feet or inserts raise the pad by approximately three inches for sufficient clearance for the tines of a forklift. The pad can be lifted and maneuvered directly by the forklift. The pallet feet or inserts can be removed from the pad and reused.

The preferred embodiment of the invention therefore provides a pad with sufficient load strength to support various types of heavy equipment in conformance with applicable building codes. The pad also functions as a transport pallet with the use of the reusable pallet feet or inserts. The pallet feet or inserts raise the pad for the clearance of a forklift to permit the pad to be easily maneuvered. The pad itself has sufficient structural strength to support the equipment while the pad is being maneuvered.

The preferred method of using the invention involves loading equipment onto a pad having a top surface, a bottom surface with at least one recess therein, and plurality of side surfaces. At least one pallet foot is inserted into the at least one recess in the bottom surface of the pad. The pad with the equipment thereon is shipped to an end user. The end user then removes the at least one pallet foot and installs the pad with the equipment thereon at the construction site. The pallet feet may then be returned to the manufacturer for reuse.

Therefore, it is an object of the present invention to provide a base for equipment that functions as an equipment pad and as a transport pallet.

It is a further object of the present invention to provide a base for equipment that is easily transported.

It is a further object of the present invention to provide a base for equipment that is light weight with high load bearing qualifies.

It is a still further object of the present invention to provide a base for equipment with removable pallet inserts.

It is a still further object of the present invention to provide reusable pallet inserts.

It is a still further object of the present invention to provide a method for shipping and installing equipment on an equipment pad.

Other objects, features, and advantages of the present invention will become apparent upon reading the following detailed description of the preferred embodiment of the invention, when taken in conjunction with the drawings and appended claims.

DETAILED DESCRIPTION OF THE INVENTION

Figure 1:
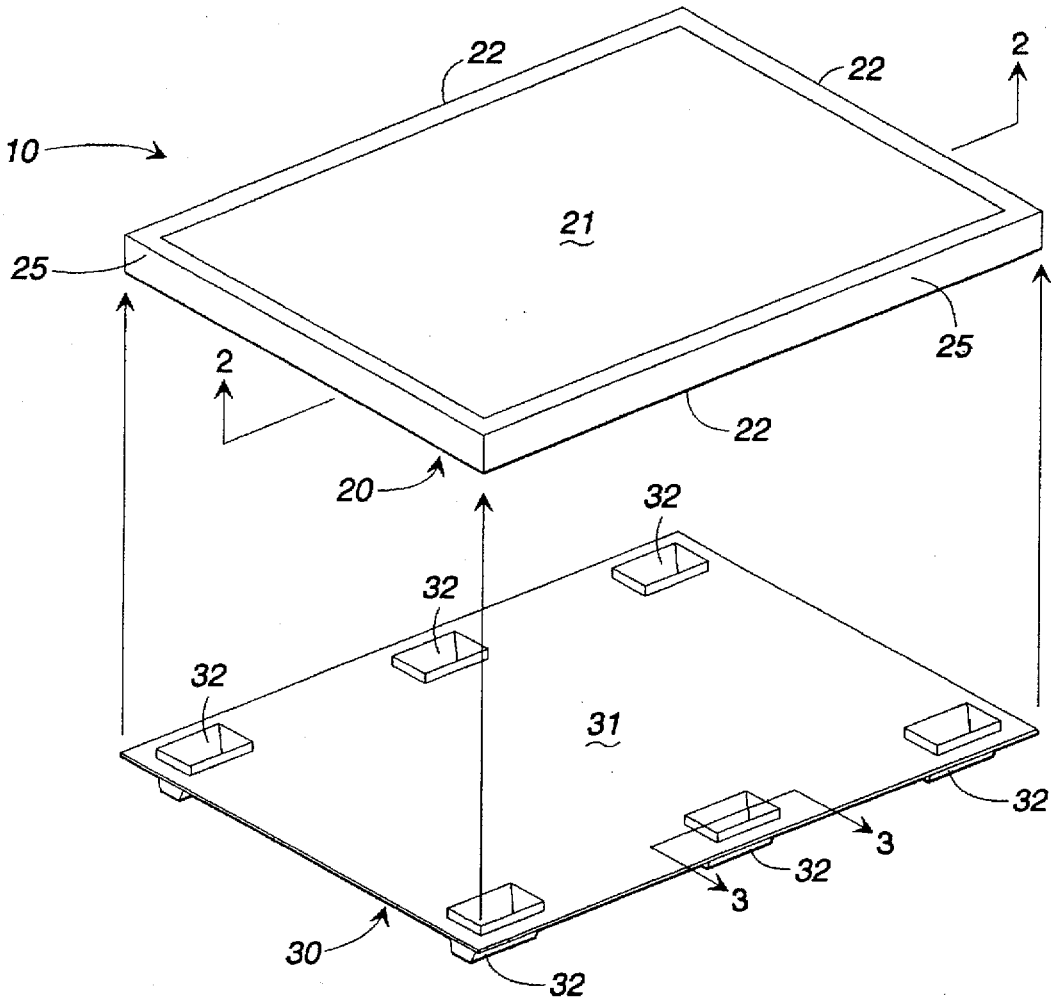
FIG. 1 is a perspective view showing the joinder of the pad and the pallet insert.
Figure 2:
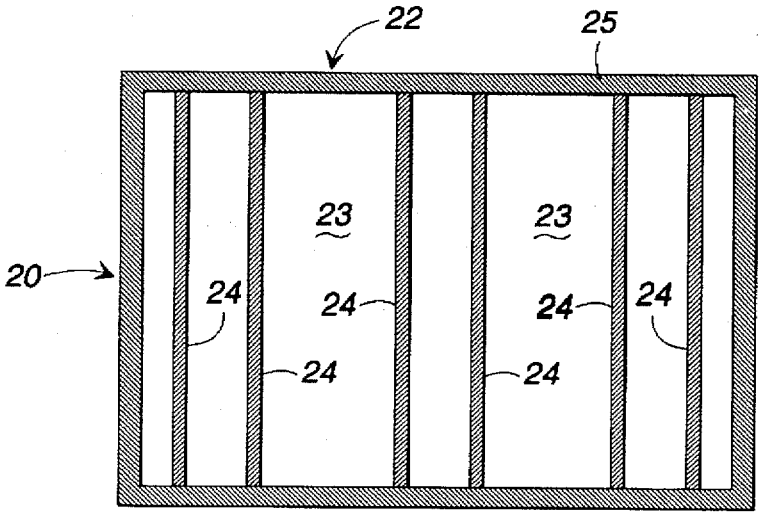
FIG. 2 is a cross sectional view of the pad showing the ribs and the edge taken along line 2—2 of FIG. 1.
Figure 3:
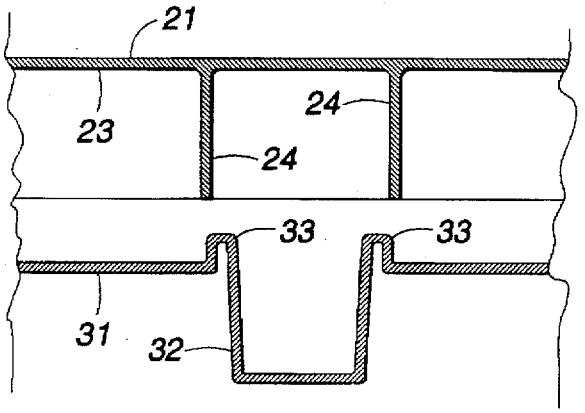
FIG. 3 is a cross sectional view of the pad and the pallet showing the ribs and the insert feet, taken along lines 3—3 of FIG. 1.

Referring now to the drawings, in which like numerals represent like parts throughout the several views, FIGS. 1 through 3 show the first embodiment of an equipment base 10. The equipment base 10 includes a pad 20 and a pallet insert 30. The pad 20 has a flat top surface 21, four flat side surfaces 22, and a bottom surface 23 with a plurality of downwardly extending support ribs 24. The periphery of the pad 20 forms an edge 25 to provide structural support for the pad 20. The ribs 24 are evenly spaced to provide the pad 20 with further structural support. The pad 20 is essentially hollow with the sides 22 and the ribs 24 being equal in length. The pad 20 is a unitary structure. The pad 20 itself is preferably constructed from molded or thermoformed plastic such as polypropylene or polyethylene.

A typical pad 20 manufactured according to this embodiment is rectangular in shape and is approximately twenty-four (24) to sixty (60) inches in length, twenty-four (24) to sixty (60) inches in width and two (2) to three (3) inches in height. The top surface 21 and the side surfaces 22 of the pad 20 are generally continuous with no recesses or holes therein because of building codes requirements. The thickness of the ribs 24 and the distance from the top surface 21 to the bottom surface 23 is generally about 0.125–0.375 inches. The edge 25 is generally about 0.125–0.375 inches thick. A pad 20 constructed according to these dimensions and constructed out of either polypropylene or polyethylene can support approximately 300 to 1000 pounds of load on typical soil.

The pallet insert 30 includes a flat sheet 31 and a plurality of downwardly projecting feet 32. The sheet 31 is also constructed from molded or thermoformed plastic or other conventional material. The feet 32 are generally hollow in shape and have a raised lip 33 that extends above the level of the sheet 31. The feet 32 can be molded integrally with the sheet 31 or formed separately and fixedly attached to the sheet 31. Although the use of six feet 32 is shown, any number of feet 32 may be employed depending upon the required load and the dimensions of the pad 20.

The sheet 31 is sized to fit within the edge 25 of the pad 21). Likewise, the feet 32 and the raised lips 33 are sized to snap fit into the ribs 24. The feet 32 are preferably four inches in length with one inch extending above the sheet 31 to mate with the ribs 24 and three inches extending below the sheet 31 to elevate the pad 20. The joinder of the feet 32 of the pallet insert 30 into the ribs 24 of the pad 20 is shown in FIG. 3. The single sheet 31 of the pallet insert 30 provides a flat surface for the bottom of the pad 20 to prevent a forklift, conveyor, or other device from hitting or applying a concentrated load to any single rib 24.

Alternative designs for this embodiment include the use of a waffle pattern or a support grid (not shown) in the place of the support ribs 24 shown in FIGS. 2 and 3. Instead of a plastic material, a composite materials, as described below, may be used. Other embodiments include an equipment pad 30 constructed from a combination of plastic and composite materials, such as a composite material pad 20 joined to plastic support ribs 24 or to plastic support ribs 24 and a plastic edge 25. Other methods of joinder for the pad 20 and the pallet insert 30 also may be used, including adhesives, mechanical fasteners, or other methods. Finally, there is no requirement that the equipment pad 10 be rectangular. Any conventional shape may be employed.

Figure 4:
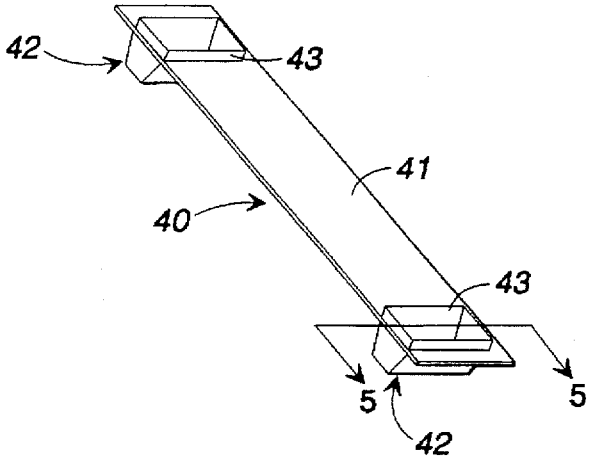
FIG. 4 perspective view of the sled insert.
Figure 5:
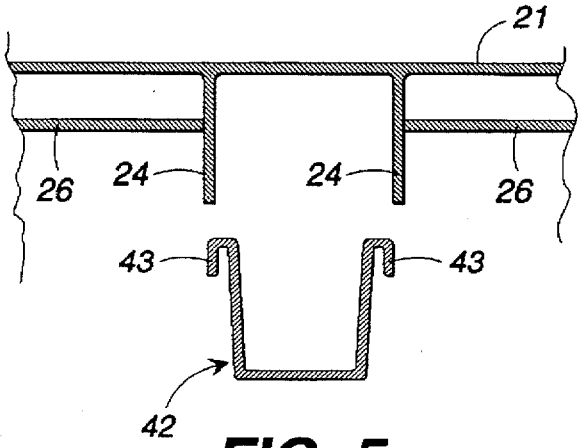
FIG. 5 is a cross sectional view of the pad and the pallet showing the ribs and the insert feet, taken along lines 5—5 of FIG. 4.

FIGS. 4 and 5 show alternative embodiment of the pallet insert 20. Rather than using a single flat sheet 31 with a plurality of feet 32, this embodiment uses a plurality of pallet sleds 40. Each pallet sled 40 has a single connecting sheet 41 and two or more downwardly projecting feet 42. The pallet sleds 40 extend the full width of the pad 20 between the edges 25. As with the first embodiment, the feet 42 are generally hollow in shape and have a raised lip 43 that extends above the level of the sheet 41. Likewise, the feet 42 can be molded integrally with the sheet 41 or formed separately and fixedly attached to the sheet 41. The pallet sleds 40 and the feet 42 also are preferably constructed from molded or thermoformed plastic or other conventional material.

The pallet sleds 40 are inserted along each set of ribs 24 on pad 20 and snap fit into place with the assistance of the raised lips 43. A pallet sled 40 is inserted into each set of ribs 24 found on the pad 20. The pallet sleds 40 prevent a forklift, conveyor, or other device from hitting or applying a concentrated load to any single rib 24. In such a configuration, it is preferred that the pad 20 itself have a flat, extended bottom surface 26 for structural strength. As is shown in FIG. 5, this bottom surface 26 creates a hollow pad 20 and functions as the single sheet 23 in the first embodiment.

Figure 6:
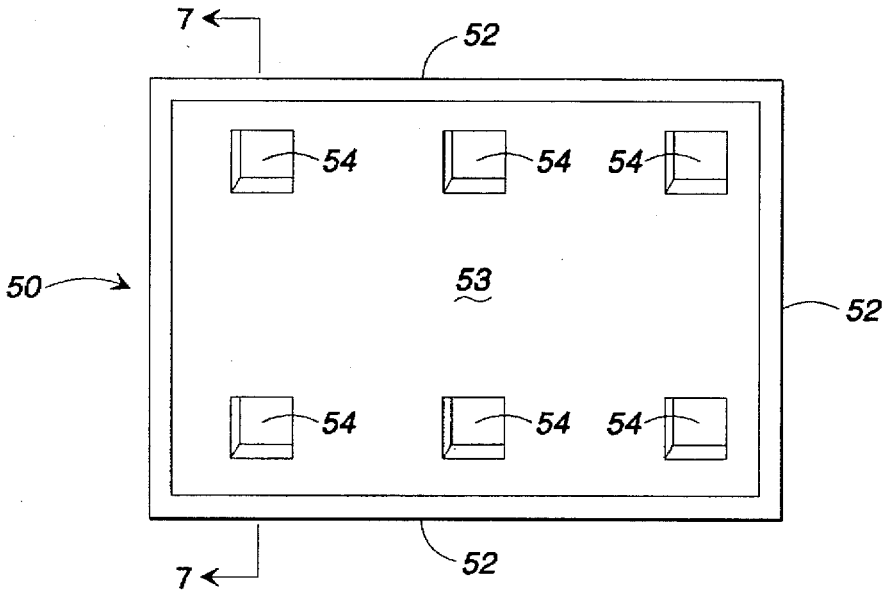
FIG. 6 is a plan view of the core of an alternative embodiment of the pad.
Figure 7:
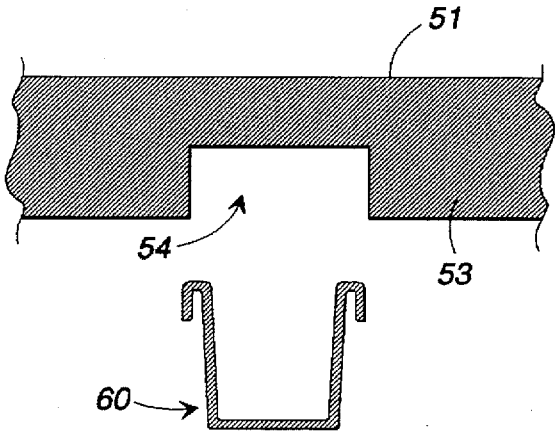
FIG. 7 is a cross sectional view of the pad showing the recesses and the insert feet, taken along lines 7—7 of FIG. 6.
Figure 8:
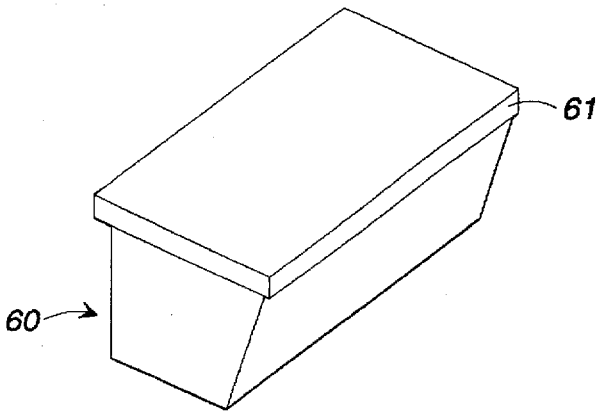
FIG. 8 is a perspective view of an insert foot.

A further embodiment of the equipment base 10 is shown in FIGS. 6 through 8. This embodiment employs a pad 50 and a plurality of insert feet 60. The pad 50 in this embodiment has a top surface 51, a plurality of side surfaces 52, and a core 53. The core 53 has a plurality of recesses 54 therein. The insert feet 60 are sized to be inserted into each of the recesses 54.

The pad 50 can be constructed from molded or thermoformed plastic. The pad 50 is essentially hollow with the recess 54 molded therein.

The pad 50 also can be constructed from various types of composite materials. For example, the composite structure found in application Ser. No. 08/416,198 (attached hereto as Appendix A) can be used. As described in detail therein, the core 53 is a rigid board, such as expanded polystyrene, and the top surface 51 and the side surfaces 52 include a reinforcing coating, such as a polyurethane foam bonded to a nonwoven fabric, and covered by a slurry mixture, such as a cementitious slurry. The recesses 54 can be formed in the expanded polystyrene of the core 53. The resultant pad 50 is a unitary structure.

The insert feet 60, similar to the previous embodiments, can be in the shape of a hollow or a solid block. The insert feet 60 can be molded or cut from expanded polystyrene, formed from plastic such as polypropylene or polyethylene, or constructed by other conventional means and materials. The insert feet 60 also may have a raised lip 61 so as to snap fit into the recesses 54 or the insert feet 60 can be joined by other conventional means such as a hot-melt glue or construction adhesives. The number of insert feet 60 is dependent upon the load requirements and the size of the pad 50. The insert feet 60 can be positioned at the corners of the pad 50 and at intermediate locations.

Numerous alternative designs for this embodiment are also possible. For example, a composite pad 50 with a lightweight core 53 can be strapped or otherwise joined to a set of plastic fibs 24 or a combination of ribs 24 and an edge 25. This configuration can then be joined to a pallet insert 30 or plurality of pallet sleds 40 as discussed above. Further, a composite pad 50 can be strapped or otherwise joined directly to a pallet insert 30 or plurality of pallet sleds 40.

In use, the respective components of the equipment base 10, the pads 20, 50 and the pallet inserts, 30, 40, 60 (collectively including the pallet insert 30, pallet sled 40, and insert feet 60) can be constructed separately. The pad 20, 50 is preferably shipped directly to an original equipment manufacturer. The equipment manufacturer secures the equipment directly to the pad 20, 50. The equipment either can be permanently secured as it will be used at the construction site, or merely secured to the pad 20, 50 for transport. Alternatively, the pad 20, 50 can be used in an assembly line process. The pad 20, 50 can be positioned on an assembly line conveyor and the equipment can be constructed and secured thereon.

The pallet inserts 30, 40, 60 are then attached to the pad 20, 50. The equipment base 10 is then complete and is shipped, together with the equipment, to the construction site or other location. The pallet inserts 30, 40, 60 raise the pad 20, 50 sufficiently off of ground level such that the equipment base 10 may be maneuvered by a forklift. The pallet inserts 30, 40, 60 are joined to the pad 20, 50 with a bond of sufficient strength such that the pallet inserts 30, 40, 60 remain in place when the pad 20, 50 is elevated by a forklift or other device. The pad 20, 50 is a unitary structure and has sufficient structural strength to support the equipment thereon while the pad 20, 50 is being transported by a forklift or other device.

The pallet inserts 30, 40, 60 are removed at the construction site and the pad 20, 50 is installed. Installation of the pad 20, 50 generally requires little site preparation beyond having an essentially flat location. The equipment may then be permanently secured to the pad 20, if not previously secured.

The pads 20, 50 themselves may be stacked three to five high while awaiting use. When a hollow configuration is used, the pallet inserts 30, 40 are also stackable for storage and to accommodate easy return to the manufacturer. After removal, the pallet inserts 30, 40, 60 can be returned to the equipment manufacturer for reuse.

The use of the recyclable inserts 30, 40, 60 results in an equipment pad 10 with no packing materials or pallets that are to be discarded at the construction site, thereby leading to lower costs and an environmentally friendly system. Further, by having the equipment already mounted on to the pad 20, 50, installation time at the construction site is reduced. The danger of damage to the equipment during the transfer from the pallet to the pad is also eliminated. The equipment and the pad can be directly installed.

Although this invention has been described in specific detail with reference to the disclosed embodiments, it will be understood that many variations and modifications may be affected within the spirit and scope of the invention as described in the following claims.

I claim:

1. A base for equipment, comprising:

a pad having a top surface, a peripheral edge, a plurality of side surfaces, and a core with a bottom side;

said top surface, said peripheral edge, and said plurality of side surfaces of said pad having a monolithic outer form;

said core having at least one recess in said bottom side; and at least one insert foot;

said at least one insert foot mating with said at least one core recess such that said at least one insert foot extends beyond said bottom side of said core.

2. The base for equipment of claim 1, wherein said pad comprises a plastic material.

3. The base for equipment of claim 1, wherein said pad comprises a composite material.

4. The base for equipment of claim 1, wherein said core comprises expanded polystyrene.

5. The base for equipment of claim 1, wherein said at least one insert foot comprises a plastic material.

6. The base for equipment of claim 1, wherein said at least one insert foot comprises expanded polystyrene.

7. The base for equipment of claim 1, wherein said insert foot mates with said recess via a snap fit.

8. The base for equipment of claim 1, wherein said core has six recesses therein for mating with six insert feet.

9. The base for equipment of claim 1, wherein said at least one insert foot raises said pad by approximately three inches.

10. The base for equipment of claim 1, wherein said at least one insert foot may be removed from said at least one recess.

11. The base for equipment of claim 1, wherein said at least one insert foot may be reused.

12. A base for equipment, comprising:

a monolithic pad having a top surface, bottom surface, and a plurality of side surfaces;

said plurality of side surfaces being immediately adjacent to Said top surface and flush therewith;

said bottom surface having at least one recess therein; and at least one insert foot;

said at least one insert foot mating with said at least one bottom surface recess such that said at least one insert foot extends beyond said bottom surface.

13. The base for equipment of claim 12, wherein said pad comprises a plastic material.

14. The base for equipment of claim 12, wherein said at least one insert foot comprises a plastic material.

15. The base for equipment of claim 12, wherein said insert foot mates with said recess via a snap fit.

16. The base for equipment of claim 12, wherein said bottom surface has six recesses therein for mating with six insert feet.

17. The base for equipment of claim 12, wherein said at least one insert raises said pad by approximately three inches.

18. The base for equipment of claim 12, wherein said at least one insert foot may be removed from said at least one recess.

19. The base for equipment of claim 12, wherein said at least one insert foot may be reused.

20. A base for equipment, comprising:

A pad having a top, a bottom, and a plurality of side surfaces;

said plurality of side surfaces being immediately adjacent to said top surface and flush therewith;

said bottom surface having a plurality of supports ribs extending therefrom; and a pallet insert with a plurality of feet;

said pallet insert mating with said ribs on said bottom surface such that said feet extend beyond said bottom surface of said pad.

21. The base for equipment of claim 20, wherein said pad comprises a plastic material.

22. The base for equipment of claim 20, wherein said pad comprises a composite material.

23. The base for equipment of claim 20, wherein said insert and said plurality of feet comprise a plastic material.

24. The base for equipment of claim 20, wherein said insert mates with said ribs via a snap fit.

25. The base for equipment of claim 20, wherein said insert has six feet.

26. The base for equipment of claim 20, wherein said insert with said plurality of feet raises said pad by approximately three inches.

27. The base for equipment of claim 20, wherein said insert with said plurality of feet may be removed from said at pad.

28. The base for equipment of claim 20, wherein said insert with said plurality of feet may be reused.

29. The base for equipment of claim 20, wherein said insert comprises a plurality of pallet sleds with a plurality of feet.

30. The base for equipment of claim 20, wherein said pad comprises an essentially hollow structure.

31. A method for transporting and installing equipment, comprising:

loading equipment onto a pad;

said pad having a top surface, a bottom surface with at least one recess therein, and plurality of side surfaces;

inserting at least one pallet insert into said at least one recess in said bottom surface of said pad;

shipping said pad with said equipment thereon to an end user;

removing said at least one pallet insert; and installing said pad on the ground with said equipment thereon.

32. The method for transporting and installing equipment of claim 31, wherein said at least one pallet insert raises said pad by approximately three inches.

33. The method for transporting and installing equipment of claim 31, wherein said at least one pallet insert may be reused.

34. The method for transporting and installing equipment of claim 31, wherein said step of loading said equipment further comprises assembling said equipment on said pad.

35. A base for equipment, comprising:

a pad having a top surface, bottom surface, and a plurality of side surfaces;

said pad having a monolithic exterior shape with said plurality of side surfaces being flushly positioned adjacent to said top surface;

said bottom surface having at least one recess therein; and at least one insert foot;

said at least one insert foot mating with said at least one bottom surface recess such that said at least one insert foot extends beyond said bottom surface.

* * * * *